US006317920B1

(12) United States Patent
Brickner et al.

(10) Patent No.: US 6,317,920 B1
(45) Date of Patent: Nov. 20, 2001

(54) VACUUM CLEANER WITH ABOVE-FLOOR CLEANING TOOL

(75) Inventors: David M. Brickner, Willoughby; John S. Murphy, Brookpark; Michael F. Wright, Stow, all of OH (US); Kyoshi Yokote, Kasiwa (JP)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/451,181

(22) Filed: Nov. 29, 1999

Related U.S. Application Data

(60) Provisional application No. 60/110,272, filed on Nov. 30, 1998.

(51) Int. Cl.[7] ..... A47L 9/12
(52) U.S. Cl. ..... 15/334; 15/352; 15/335
(58) Field of Search ..... 13/331, 332, 334, 13/335, 352

(56) References Cited

U.S. PATENT DOCUMENTS

| | | | | |
|---|---|---|---|---|
| 1,829,582 | | 10/1931 | Carson . | |
| 2,375,331 | * | 5/1945 | Taylor | 15/332 |
| 3,460,188 | | 8/1969 | Boyd . | |
| 3,482,276 | | 12/1969 | Fillery . | |
| 3,618,158 | | 11/1971 | Wörwag . | |
| 4,167,798 | * | 9/1979 | KLugl et al. | 15/334 |
| 5,247,719 | * | 9/1993 | Wareham et al. | 15/331 |
| 5,500,979 | | 3/1996 | Wörwag . | |
| 5,586,358 | * | 12/1996 | Wolfe et al. | 15/334 |
| 5,617,611 | * | 4/1997 | Worwag | 15/335 |
| 5,765,258 | | 6/1998 | Melito et al. . | |
| 5,896,617 | * | 4/1999 | Kasen et al. | 15/320 |
| 5,940,930 | * | 8/1999 | Oh et al. | 15/319 |
| 6,012,200 | * | 1/2000 | Murphy et al. | 15/352 |

FOREIGN PATENT DOCUMENTS 237140 1/1962 (AU) .

* cited by examiner

*Primary Examiner*—Terrence R. Till
(74) *Attorney, Agent, or Firm*—Fay, Sharpe, Fagan, Minnich & McKee, LLP

(57) ABSTRACT

A vacuum cleaning including a nozzle base comprising a primary and secondary suction opening, a suction source positioned within a first cavity in the nozzle base, and a dust cup releasably positioned within a second cavity in the base. The dust cup comprises a first inlet in communication with the primary suction opening, a second inlet in communication with the secondary suction opening, and an outlet. An above floor cleaning tool is in communication with the second inlet. A first filter assembly is positioned adjacent the outlet of the dust cup. A second filter is positioned between the suction source and the first filter. An exhaust opening and filter are positioned downstream of the suction source to prevent particles from venting to atmosphere. The vacuum cleaner further includes a handle assembly comprising an elongated connecting portion and a handle. The handle is removable for use as a handle for an above-floor cleaning tool. The elongated connecting portion is removable for use as a wand for an above-floor cleaning tool. A hose is removably attached to the nozzle base and to the handle.

29 Claims, 12 Drawing Sheets

VACUUM CLEANER WITH ABOVE-FLOOR CLEANING TOOL

This application claims priority from Provisional Application Ser. No. 60/110,272 filed on Nov. 30, 1998.

BACKGROUND OF THE INVENTION

The present invention relates to vacuum cleaners. More particularly, the present invention relates to an easily used and easily stored lightweight upright vacuum cleaner with an above-floor cleaning tool for suctioning dirt and debris from carpets, floors and above-floor surfaces.

Upright vacuum cleaners are continually being improved and enhanced with larger, more powerful motors and with an assortment of cleaning accessories and attachments. As upright cleaners are enhanced in this manner, they correspondingly increase in size and weight. The height and the footprint of the nozzle base portion of the cleaner have become larger to accommodate the more powerful motors and, perhaps, some accessories. These enhanced upright cleaners are too heavy and occupy too much storage space to be owned by people dwelling in small apartments, trailers, dormitories, and similar locations with limited storage area. Their size also makes cleaning under beds and other furniture difficult. The handle of many such cleaners is connected to the top of the nozzle base, which undesirably increases the overall height of the nozzle base when the handle is reclined for cleaning under beds and the like. Often, the location of the filter bag and the design of the hinge interconnecting the handle portion to the nozzle base portion prevents the handle from being pivoted downward sufficiently far to approach the surface being cleaned as is required for cleaning under furniture. Furthermore, known upright cleaners are too heavy and do not provide an effective means for hanging storage. Rather, they must be stored on the floor of a closet or in the corner of a room.

Upright vacuum cleaners generally utilize large filter bags to capture the dirt and dust liberated from the subjacent surface being cleaned. These bags are either housed in or connected to the upper handle portion of the cleaner. When full, these bags must be disconnected from the cleaner, disposed of, and replaced. The operator of the cleaner must purchase replacement bags regularly. Furthermore, the bag changing operation is time consuming, and some people object to utilizing disposable filter bags. In addition to the space occupied by the filter bag and its cloth or plastic housing, as these bags fill with dirt, the upper portion of the cleaner becomes quite heavy making the vacuum cleaner unbalanced.

Another drawback associated with known upright vacuum cleaners is their lack of an easy to use and effective power cord storage mechanism. Some upright cleaners utilize a mechanism that retracts the power cord into the upper handle portion of the cleaner. Others utilize a pair of spaced hooks connected to the handle around which the cord is wound. The provision of a retractable cord adds complexity, weight, and expense to the vacuum cleaner. The spaced hooks are inconvenient, require the operator to bend over each time the cord is wound around or unwound from the hooks, and do not provide a mechanism for quick and secure short-term storage of the cord. The cord must either be loosely draped over the handle where it is insecure and becomes tangled, or the cord must be completely wrapped around the hooks each time one desires to store the cord.

While certain upright cleaners have been designed in an effort to overcome some of the foregoing deficiencies, they have not been successful. One known cleaner utilizes a dust cup in the nozzle base portion to collect dirt and dust in place of the filter bag. However, the dust cup is difficult to remove from the cleaner. In order to empty the contents of the dust cup, the operator must grasp the filter assembly with two hands. This can result in the spillage of the contents of the dust cup when it becomes separated from the filter assembly.

It would also be desirable to have a lightweight upright vacuum cleaner with an above-floor cleaning tool which is easily removed from and used with the vacuum cleaner.

It would also be desirable to have a lightweight upright vacuum cleaner with a handle which can also be used as a handle for an above-floor cleaning tool and an elongated connecting portion which can serve as a wand extension for the above-floor cleaning tool.

It would also be desirable to have a lightweight upright vacuum cleaner in which the rotation of the brushroll can be stopped for bare floor cleaning and in which communication between the floor nozzle of the vacuum cleaner and the removable dust container can be blocked when the vacuum cleaner is used for above-floor cleaning or corner cleaning.

Accordingly, it is desirable to develop a new and improved upright vacuum cleaner which would overcome the foregoing deficiencies and others while meeting the above-stated needs and providing better and more advantageous overall results.

SUMMARY OF THE INVENTION

The present invention relates to a new and improved upright vacuum cleaner.

More specifically, the upright vacuum cleaner is used with an above-floor cleaning tool for cleaning carpets, floors and above-floor surfaces. Various cleaning tools can be attached to the handle of the vacuum cleaner for above-floor cleaning.

The vacuum cleaner is comprised of a nozzle base comprising a primary suction opening and a secondary suction opening formed therein, a suction source positioned within a first cavity defined in the nozzle base, and a dust cup assembly releasably positioned in a second cavity defined in the nozzle base which forms a dirt and dust collecting chamber.

The dust cup assembly comprises a first inlet which is in fluid communication with the primary suction opening, an outlet which is in fluid communication with the suction source, and a second inlet which is in fluid communication with the secondary suction opening and with an above-floor cleaning tool. A sealing gasket is positioned adjacent the second suction opening.

A filter assembly is releasably positioned adjacent the outlet of the dust cup assembly. The filter assembly comprises a first filter and a filter frame.

A cover is releasably attached to the filter frame and forms a rear wall of the dust cup assembly. The cover comprises an inlet conduit and an outlet opening. The inlet conduit is connected to the second inlet. The cover further comprises a handle.

A second filter is positioned between the suction source and the first filter to prevent a flow of dirt and dust from the dirt and dust collecting chamber to the suction source. An exhaust opening is positioned downstream of the suction source and an exhaust filter is located adjacent the exhaust opening to prevent particles that enter the suction source from venting to atmosphere.

The vacuum cleaner further comprises a handle assembly comprising an elongated portion removably attached to the nozzle base at a first end of the elongated portion, and a handle removably attached to a second end of the elongated portion.

The handle is removed from the elongated portion for use as an above-floor tool handle. A hose is removably attached to the handle at a hose first end and is removably attached to the nozzle base at a hose second end. At least one clip secures the hose to the elongated portion.

A tool caddy is mounted onto the elongated handle portion and houses at least one above-floor cleaning tool. The above-floor cleaning tool is removably attached to the handle first end. The elongated handle portion can be removed from the nozzle base for use as a wand for an above-floor cleaning tool.

One advantage of the present invention is the provision of a new and improved vacuum cleaner.

Another advantage of the present invention is the provision of an upright vacuum cleaner that eliminates the need for filter bags.

Still another advantage of the present invention is the provision of an upright vacuum cleaner having a low profile nozzle base so that it can fit beneath furniture for effective cleaning.

Yet another advantage of the present invention is the provision of a lightweight upright vacuum cleaner that can be hung for storage.

A further advantage of the present invention is the provision of an upright vacuum cleaner having a removable dust cup located in a nozzle base and having an easy to remove and easy to replace filter assembly.

A yet further advantage of the present invention is the provision of an upright vacuum cleaner having a removable dust cup which has a first inlet communicating with a floor nozzle and a second inlet communicating with an auxiliary above-floor cleaning tool wherein both the first and second inlets can be selectively closed.

An additional advantage of the present invention is the provision of an upright vacuum cleaner which has, in addition to a brushroll, a filter chamber and a motor and fan assembly housed in a nozzle base so that a handle of the vacuum cleaner does not serve as a housing, or even an attachment point, for either of these items.

A further advantage of the present invention is the provision of an upright vacuum cleaner with a handle assembly including a removable handle which also serves as a handle for the above floor cleaning tool and an elongated connecting portion which serves as a wand for above-floor cleaning.

Another advantage of the present invention is the provision of an upright vacuum cleaner having a first filter which serves as a primary filter for a dust cup held in the nozzle base, a second filter which serves as a secondary filter between the primary filter and a motor/fan assembly, and an exhaust filter which serves to filter any contaminants which may be exhausted from the motor/fan assembly.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
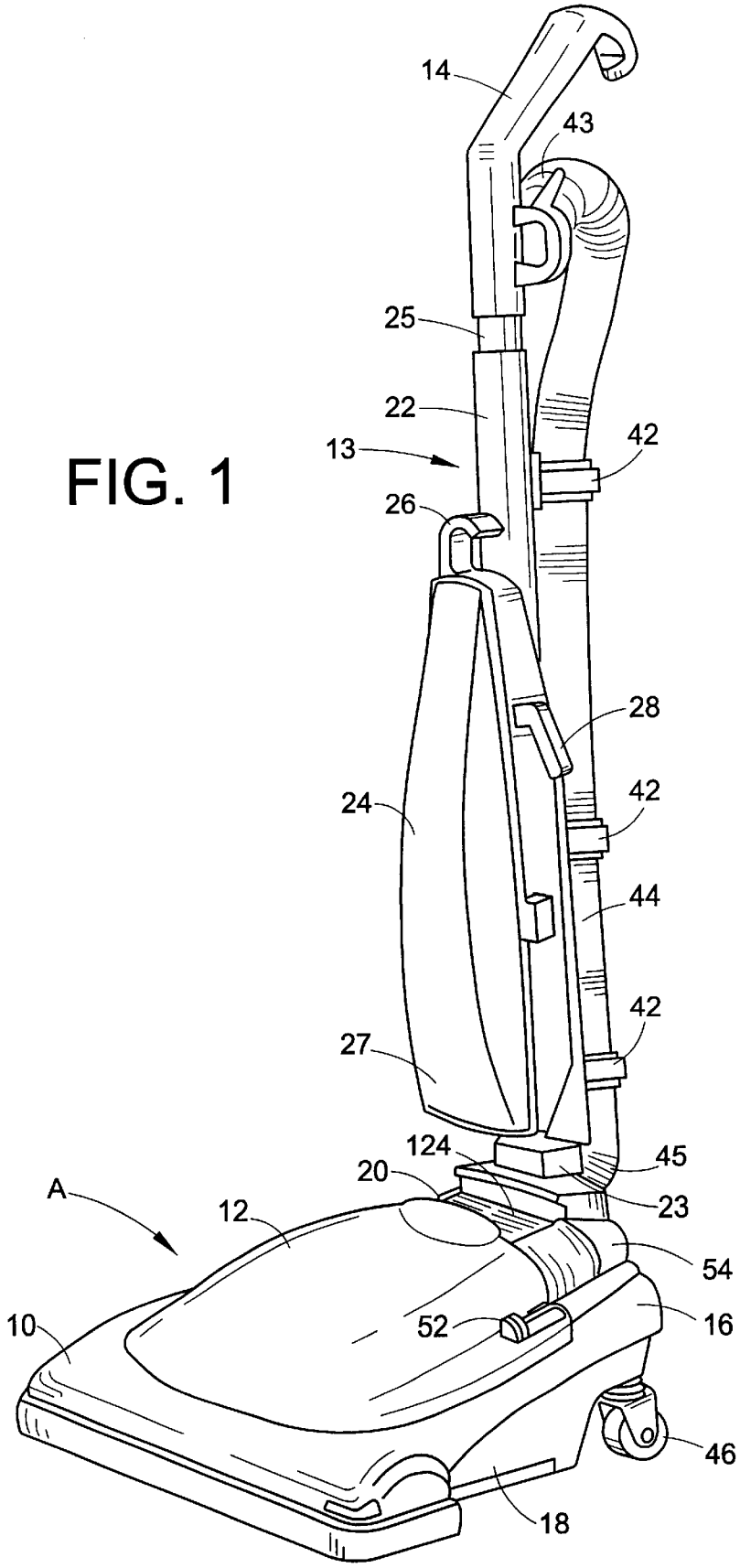
FIG. 1 is a perspective view of the vacuum cleaner according to a preferred embodiment of the present invention.

Referring now to the drawings, wherein the showings are for purposes of illustrating a preferred embodiment of this invention only and not for purposes of limiting same, FIG. 1 shows a vacuum cleaner A according to the present invention. The vacuum cleaner A comprises a floor traveling head 10, or nozzle base, accommodating a dust cup 12, and a handle assembly 13 pivotally mounted on the floor-traveling head. The handle assembly 13 includes a removable handle element 14. The floor traveling head 10 includes a nozzle cover or upper housing 16 and a base or lower housing 18. A motor and fan assembly or suction source 19 (FIG. 3) is positioned within a first cavity 17 (FIG. 8A) in the nozzle base. The dust cup 12 is releasably positioned in a second cavity 21 (FIG. 4A) defined in the nozzle base 18. The dust cup 12 defines a dirt and dust collecting chamber.

The vacuum cleaner further comprises a motor cover 20 which is positioned over the motor/fan assembly 19 at the rear of the nozzle base 18. An elongated connecting portion 22, having a first end 23 and a second end 25, is removably attached to the floor-traveling head 10 at its first end. The handle 14 is removably attached to the elongated connecting portion second end 25.

The lower housing 18 supports the various components of the head. The two housing members 16, 18 are fastened to each other, but do not entirely enclose the motor and fan assembly therebetween. The two housing members 16, 18 thus form part, but not substantially the entirety, of the housing. In addition to these two housing members there is the upper motor housing cover 20, which covers upper portions of the motor and fan assembly. In combination, the three housing members 16, 18, 20 thus form substantially the entirety of the housing for the floor-traveling head 10.

Figure 2:
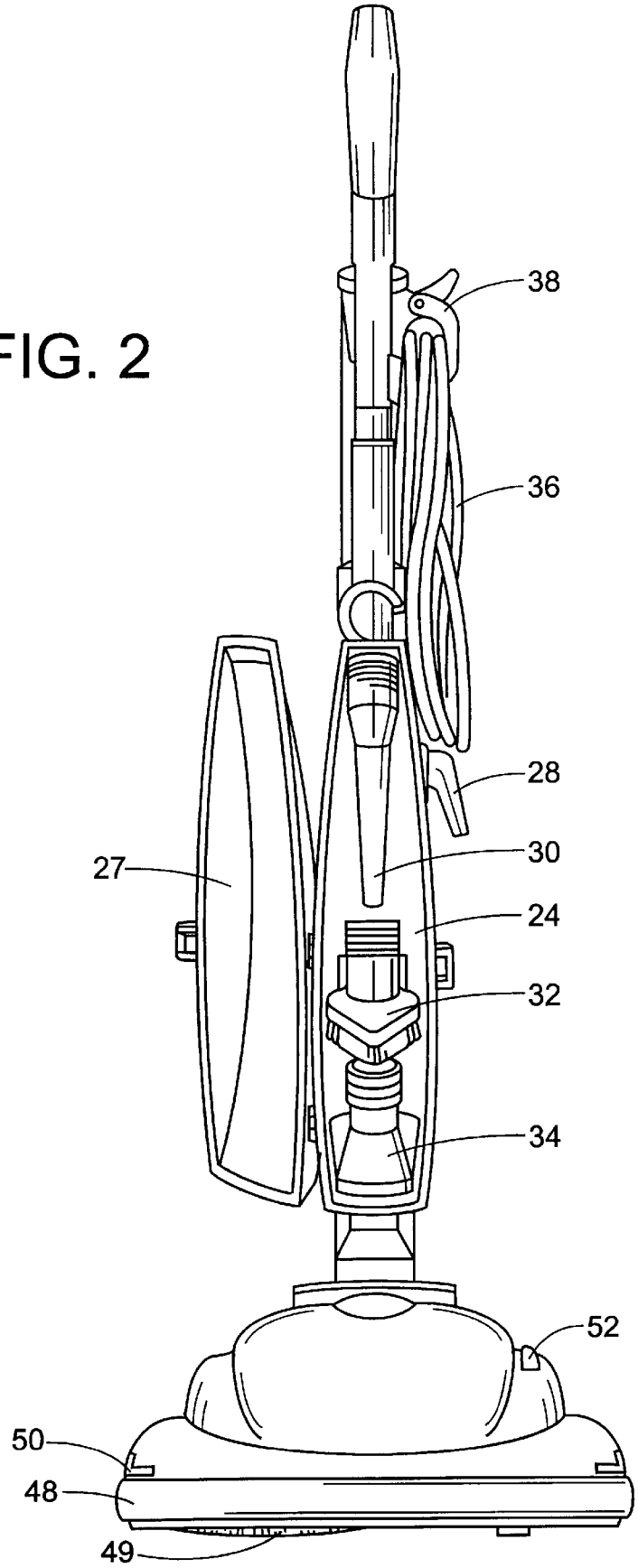
FIG. 2 is a front elevational view of the vacuum cleaner of FIG. 1 showing an opened tool caddy.

A tool caddy 24 is removably mounted to the elongated connecting portion 22. The tool caddy 24 includes a storage hook 26 and an arm 28 which is used to wrap or store a power cord 36 (FIG. 2). The tool caddy 24 can be stored separately via the storage hook 26. The tool caddy 24 houses at least one above-floor cleaning tool. Referring to FIG. 2, the tools can include a crevice tool 30, a POWER EDGER™ tool 32, and a 2-in-1 dust brush/upholstery tool 34. These tools are used separately in conjunction with the handle 14 to perform above-floor cleaning or corner cleaning.

A quick cord clip 38 is provided on the elongated connecting portion 22 for securing the power cord 36 in a storage position. If desired, the power cord 36 can be wound around an upper portion of the quick cord clip 38 and the arm 28, instead of being looped so as to hang from the cord clip.

Figure 11C:
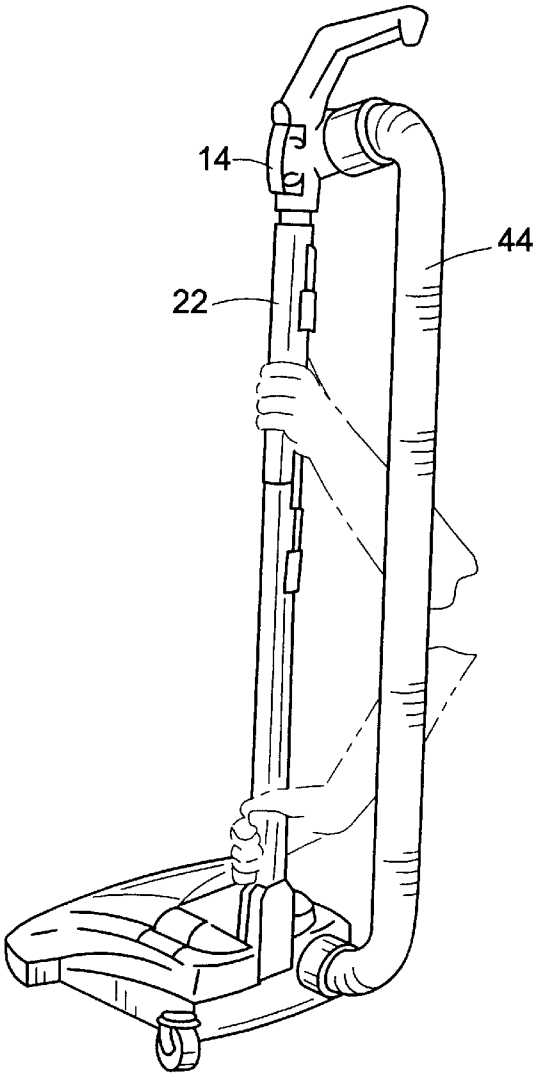
FIGS. 11A–11F are a set of six perspective views illustrating the use of a detachable handle assembly and hose of the vacuum cleaner of FIG. 1 for above-floor cleaning and corner cleaning.
Figure 11B:
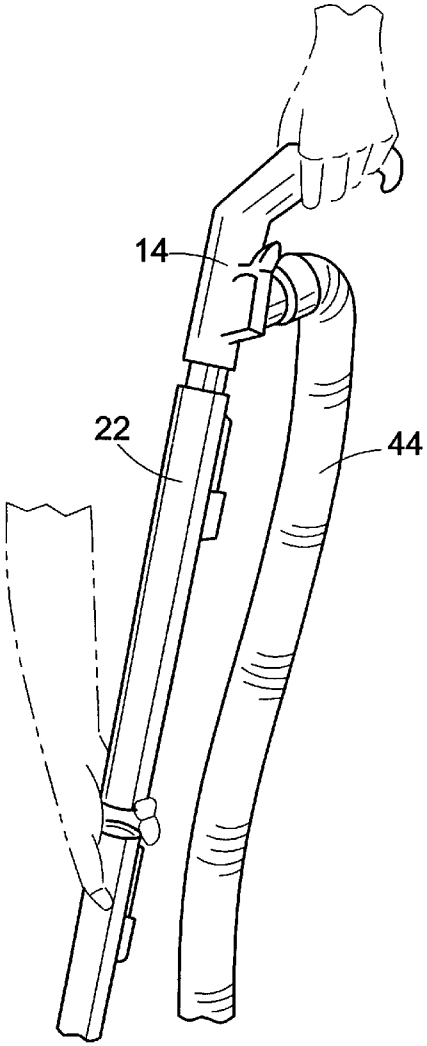
Figure 11A:
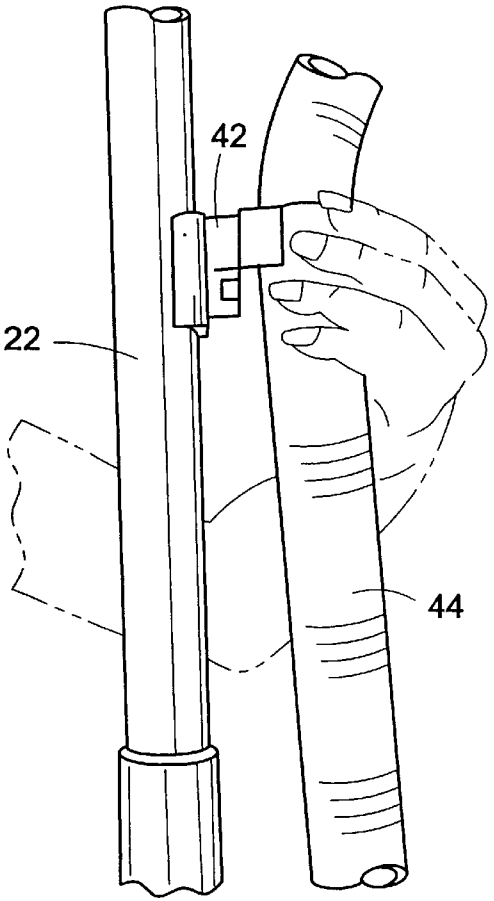
Figure 11F:
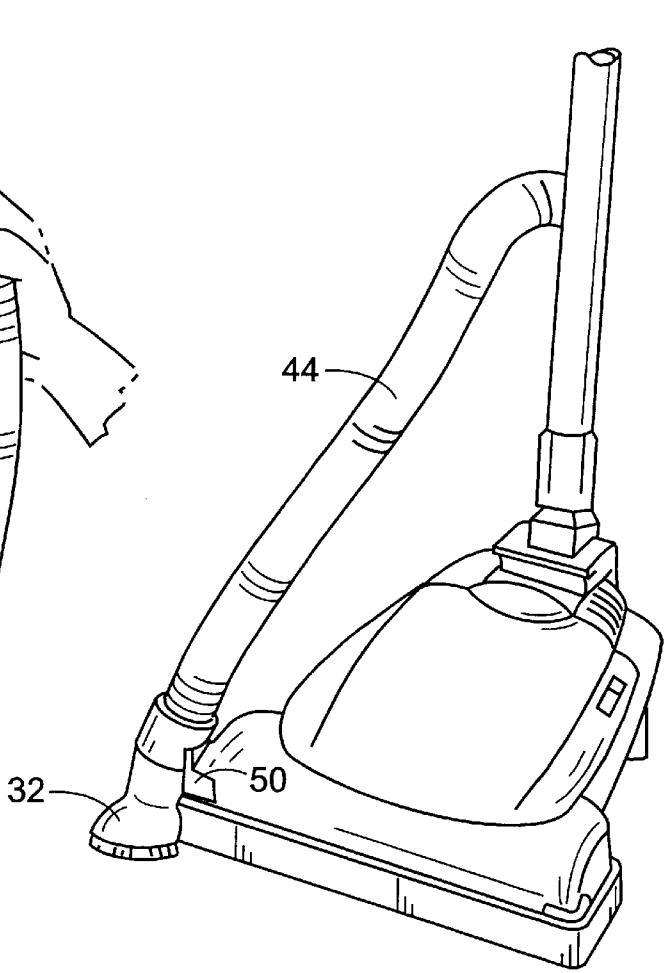
Figure 11E:
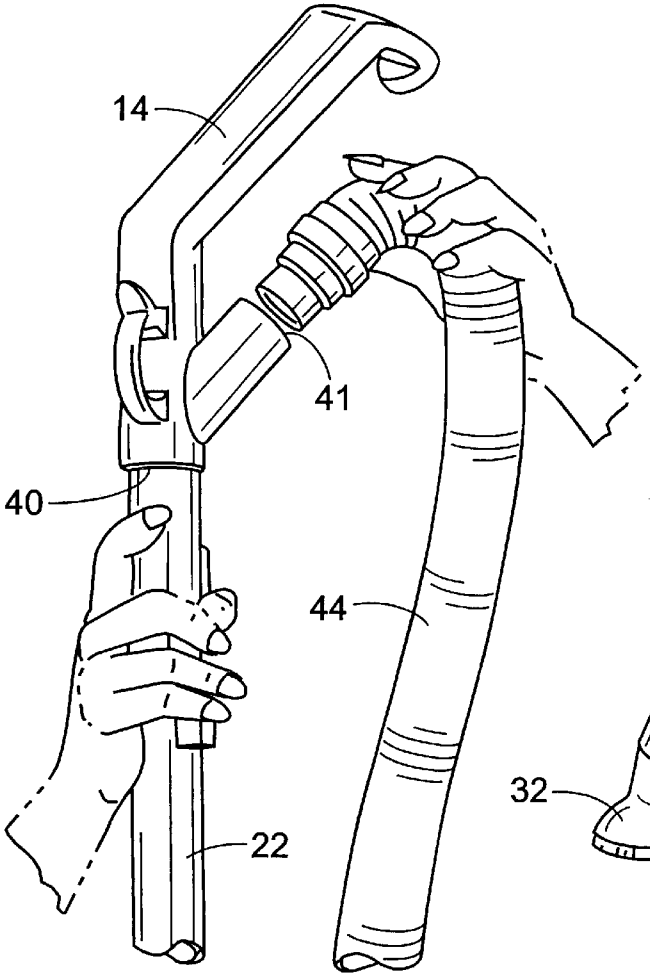
Figure 11D:
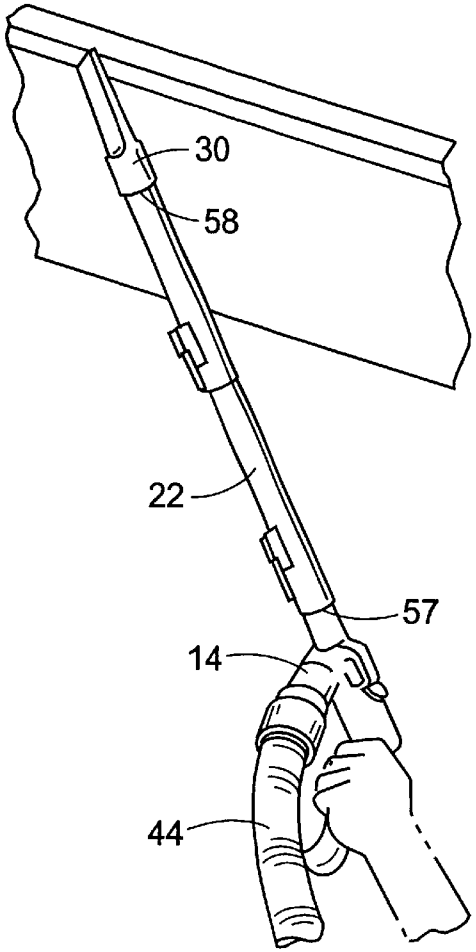

With reference to FIG. 11E, the handle 14 is removed from the elongated connecting portion 22 for use as a handle for an above-floor cleaning tool. A hose 44 is removably attached to the handle 14 at a hose first end 43 and is removably attached to the floor-traveling head 10 at a hose second end 45. Such use is shown in FIG. 11D. Clips 42 secure the hose 44 to the elongated handle portion 22. The hose 44 is used with the above-floor cleaning tools.

Casters 46 are located at the rear of the floor traveling head 10 to facilitate horizontal movement of the vacuum cleaner along a floor surface to be cleaned. At the front of the floor traveling head 10 is a wraparound bumper 48 which protects the floor traveling head if the vacuum cleaner bumps into furniture or a wall or other surface. The bumper 48 also protects furniture and walls from being damaged by the vacuum cleaner.

Figure 3:
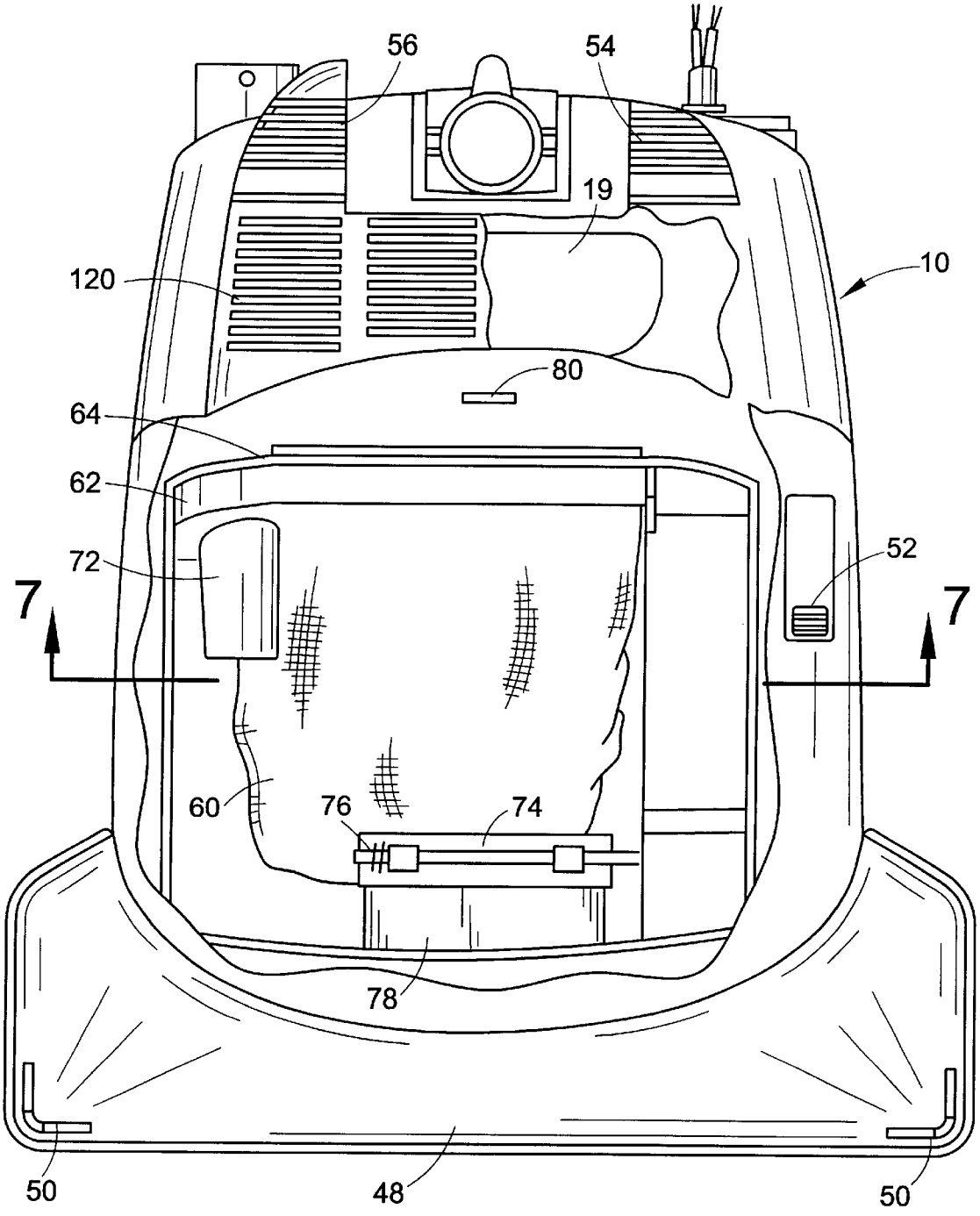
FIG. 3 is a top plan view of a floor-traveling head of the vacuum cleaner of FIG. 1, partially broken away to illustrate a dust cup and filter assembly.
Figure 8A:
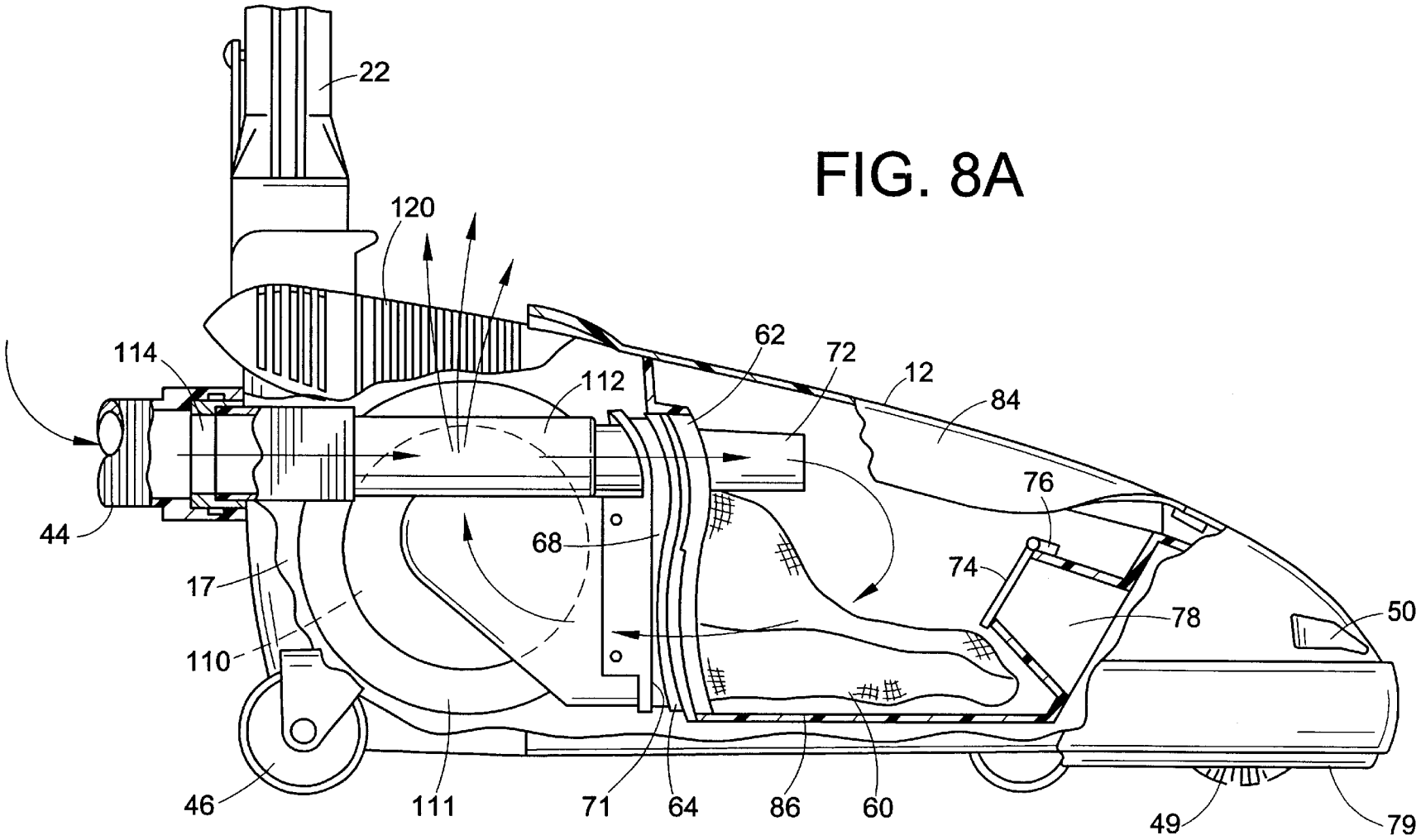
FIG. 8A is a side elevational view in cross section of the nozzle base of the vacuum cleaner of FIG. 1 illustrating air suction through a secondary suction opening, the dust cup and to an exhaust filter during use of an above-floor cleaning tool.
Figure 8B:
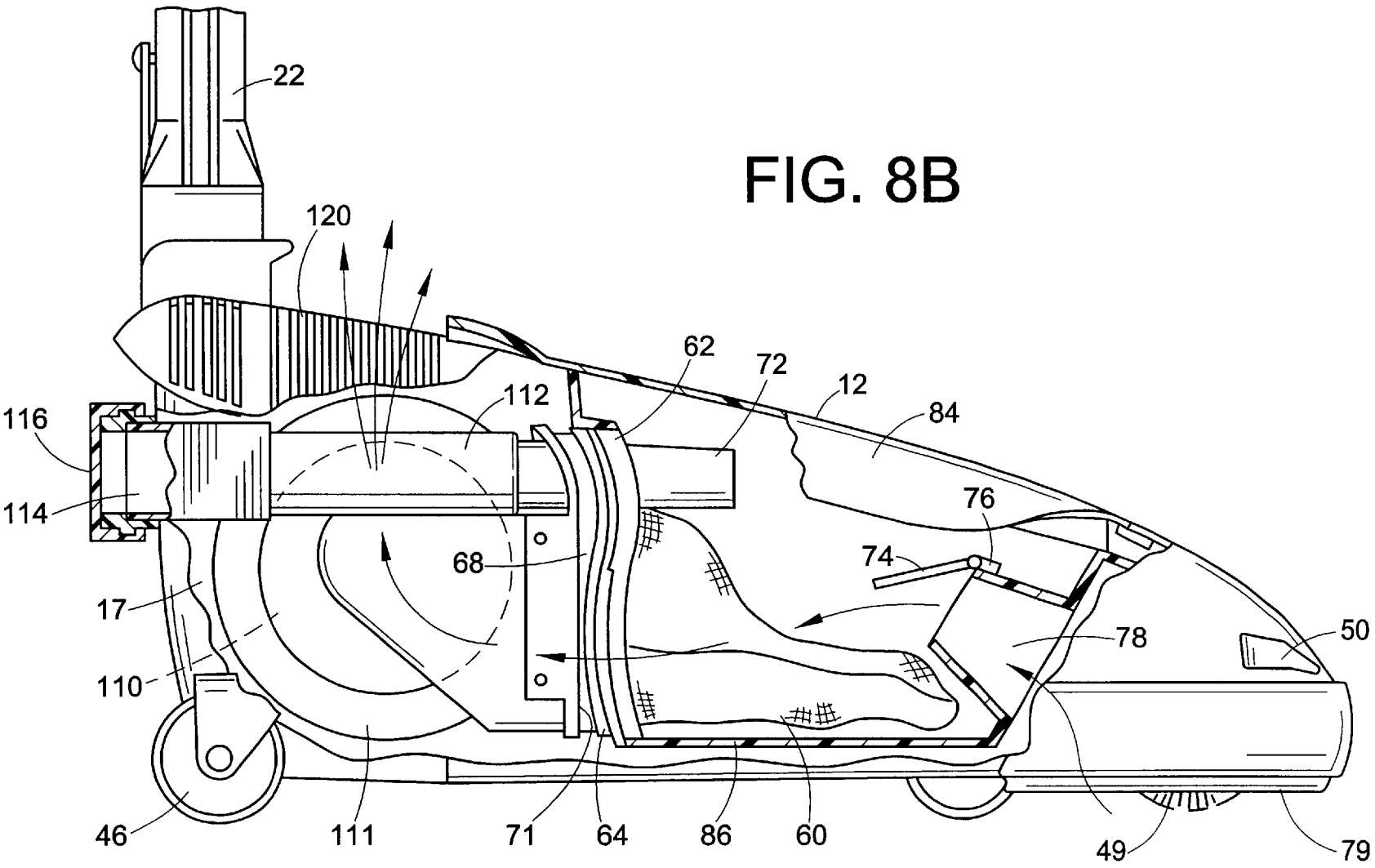
FIG. 8B is a side elevational view in cross section of the nozzle base of FIG. 1 illustrating air suction through a primary suction opening to the dust cup and to the exhaust filter during carpet or floor surface cleaning.

With reference now to FIG. 8B, a brushroll 49 extends beneath the floor-traveling head 10. The brushroll 49 is used to agitate the carpet or surface to be cleaned and aids in loosening dirt, dust and other particles for vacuuming into the vacuum cleaner. As shown in FIG. 3, POWER EDGER™ tool slots 50 are provided adjacent the wraparound bumper 48. Use of the POWER EDGER™ tool 32 is shown in FIG. 11F.

With reference again to FIG. 3, a selector switch 52, protruding through the upper housing 16, allows switching between a) bare floor cleaning, b) carpet cleaning, and c) above-floor cleaning. When the selector switch 52 is in the back position, the vacuum cleaner is ready to sweep carpeted surfaces. In the middle position, the vacuum cleaner is ready to sweep bare floors. In the forward position, the vacuum cleaner is ready to clean above-floor surfaces.

In the back position of the selector switch 52, the brushroll 49 is driven. In the middle position of the selector switch 52, however, the brushroll 49 is disconnected from the motor. In the forward position of the selector switch 52 the brushroll 49 remains disengaged from the motor.

An on/off switch 54 is provided at the rear of the nozzle base to activate the motor. A handle release pedal 56 is provided to release the handle assembly 13 from its locked upright position on the floor-traveling head 10 so as to allow rearward pivoting of the handle assembly.

Figure 5:
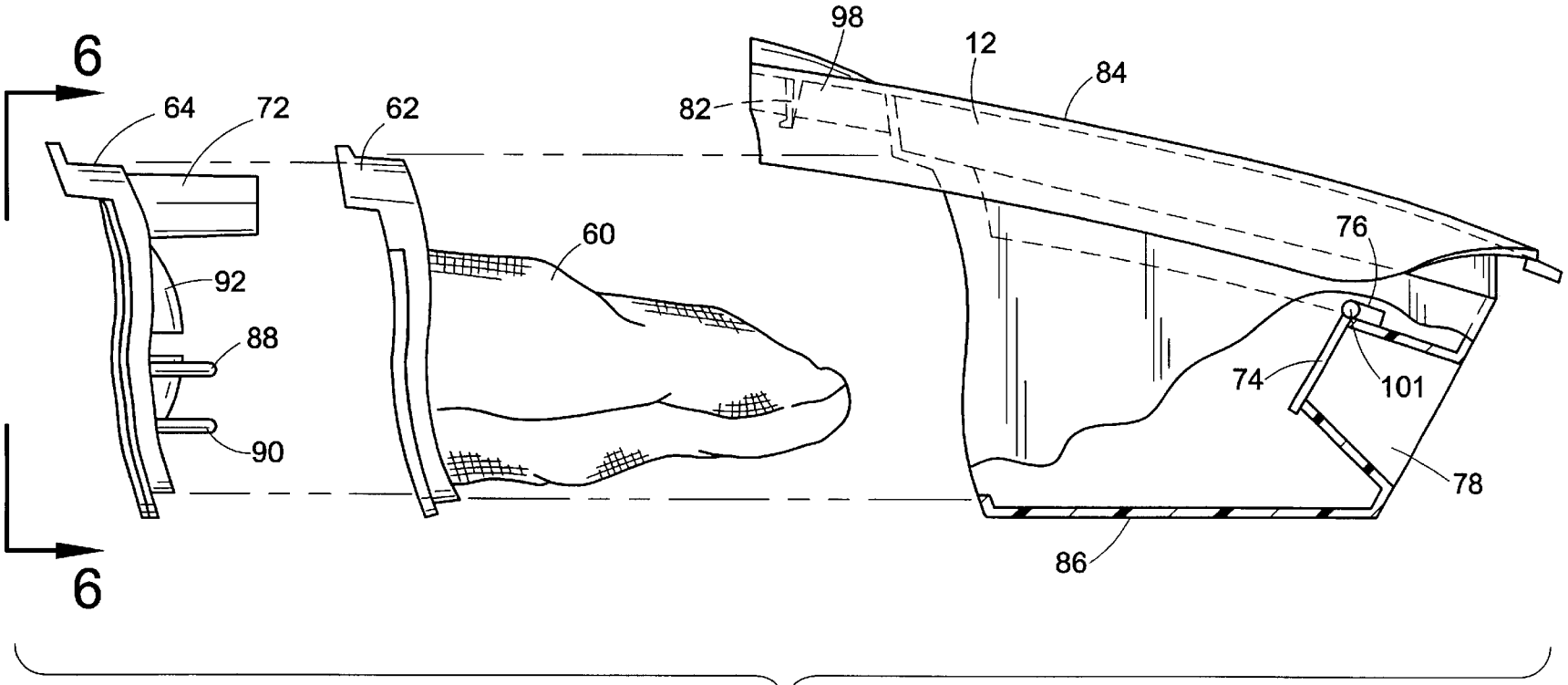
FIG. 5 is an exploded side elevational view illustrating the dust cup and filter assembly of the vacuum cleaner of FIG. 1.

Referring now to FIG. 5, the vacuum cleaner further comprises a first filter 60 and a filter frame 62. The filter 60 is made of a thermoplastic material or cloth. The filter 60 has a fine grid with holes which are large enough to allow air to pass through but small enough to trap dust and debris within the dust cup. The filter 60 is shaped like a bag so that the dust cup 12 becomes full of dust and debris before the filter becomes clogged with dust and debris. If the filter 60 were a flat panel or wall of the dust cup, the filter would more likely become clogged with dust and debris before the dust cup became full.

The filter frame 62 is made preferably from a resilient thermoplastic material or other resilient material. The filter frame 62 should be flexible to be able to be easily installed within the dust cup. A cover 64 is releasably attached to the filter frame 62. The cover 64 forms a rear wall of the dust cup assembly 12. The cover 64 is also preferably made from a resilient thermoplastic material or other resilient material. The filter frame 62 and cover 64 when installed together within the dust cup form a seal around the outside edges of the dust cup to prevent dust and debris from escaping from the dust cup and entering the motor/fan assembly.

Figure 6:
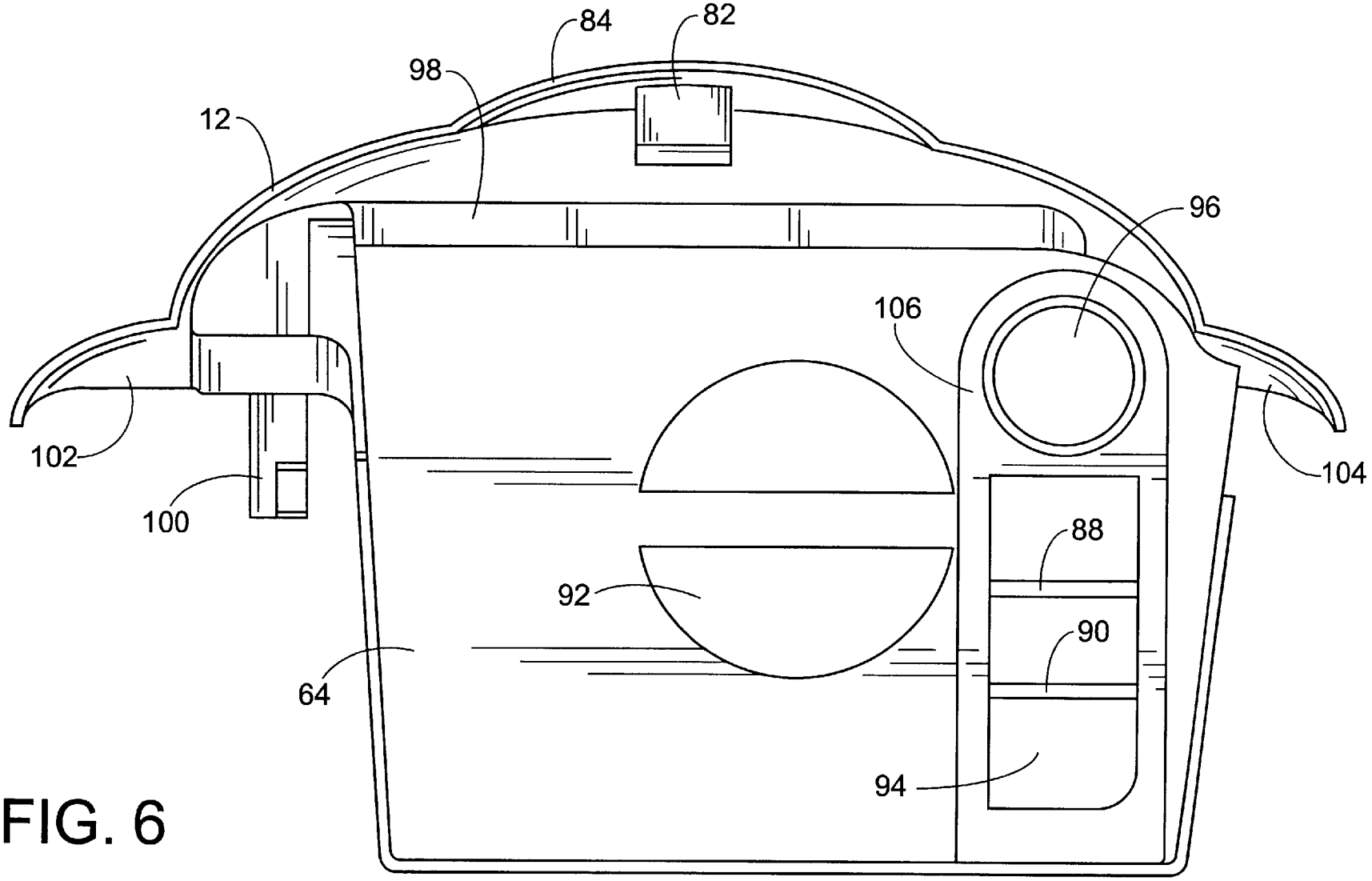
FIG. 6 is a rear elevational view of the dust cup and a cover.
Figure 7:
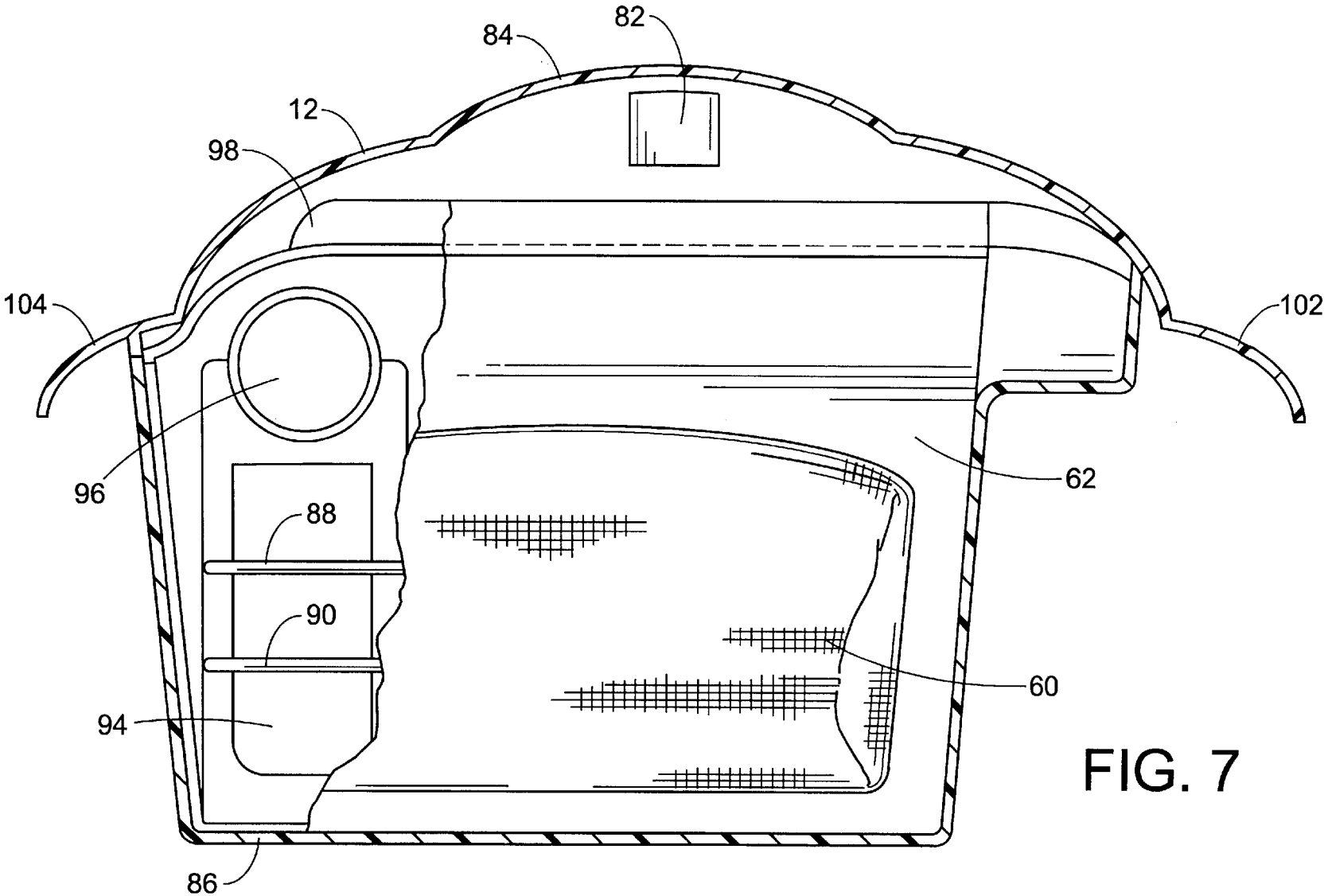
FIG. 7 is a front elevational view, partially broken away, of the dust cup and filter assembly of FIG. 5 with the dust cup shown in cross section.

The dust cup 12 has a top surface 84 and a bottom surface 86. A latch 82 located on a ledge 98 extending from the top surface 84 is used to engage the dust cup with a slot 80 (FIG. 3) in the floor-traveling head 10. Lips 102 and 104 (as shown in FIGS. 6 and 7) extend from opposite ends of the top surface 84 of the dust cup for engaging opposite sides of the upper housing 16 adjacent the second cavity 21 which holds the dust cup 12.

Referring to FIGS. 3 and 5, the dust cup 12 comprises a first inlet opening 78 which is in fluid communication with the primary suction opening 79 (FIG. 8B) of the vacuum cleaner adjacent the brushroll 49. The dust cup 12 also has a door 74 with a spring 76 which biases the door to a closed position to seal the first inlet opening 78. In the back and middle positions of the selector switch 52, the door 74 is pushed into an open position by suction air and the air pressure differential between the air inside the dust cup and the ambient air. In the forward position of the selector switch 52, however, the door 74 covering the inlet opening 78 of the dust cup 12 is closed, as shown in FIG. 8A. Such closure takes place due to an actuating finger (not shown) being retracted from an extension arm 100 (FIG. 6) of the door 74 allowing the door to rotate around a pivot 101 (FIG. 5) as urged by the resilient bias of the spring 76. In this position, suction takes place through an above-floor tool such as, e.g., the crevice tool 30 shown in FIG. 11D.

Referring to FIGS. 5, 6, 8A and 8B, the cover 64 further includes an inlet conduit 72 which forms a second inlet opening 96 of the dust cup. A pair of conduits 112, 114 located within the nozzle base connect to the conduit 72 and extend, via hose 44, to the above floor-cleaning tool. A cap 116 is placed over the opening of conduit 114 when the hose 44 is removed from the vacuum cleaner. This prevents a suction being drawn through the conduit 72 thus selectively closing the second inlet opening 96 of the dust cup.

Figure 4A:
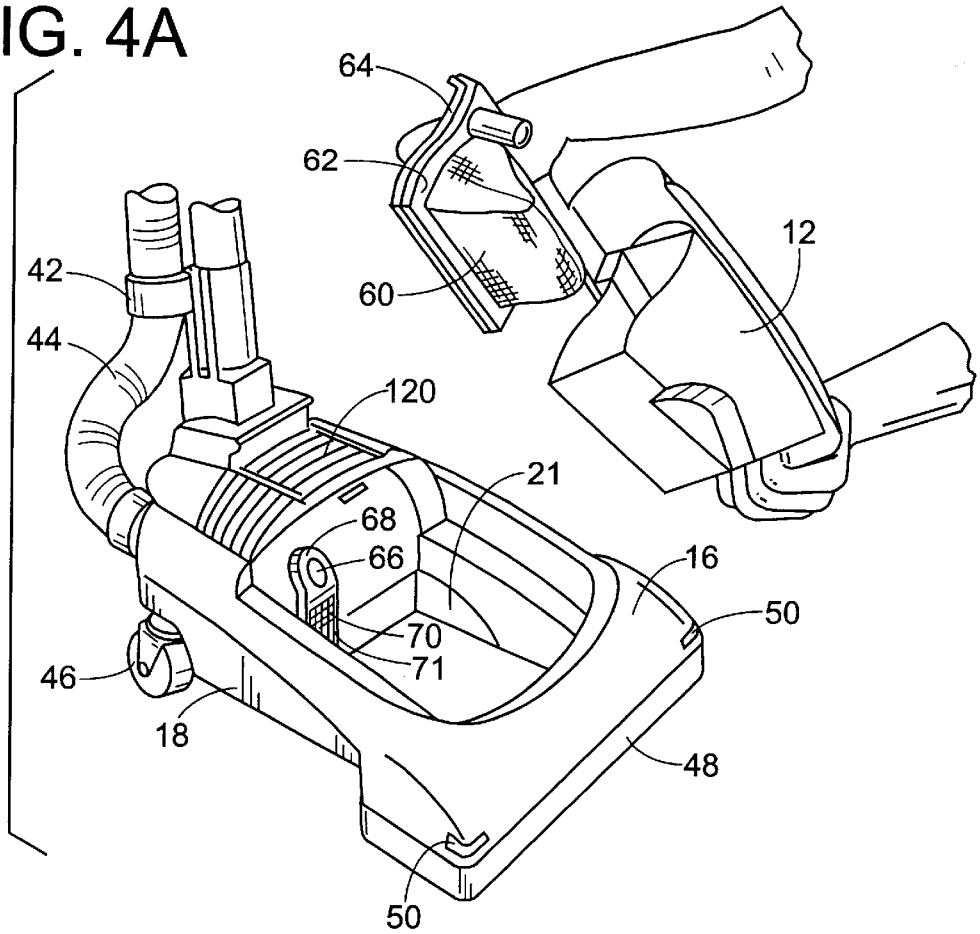
FIGS. 4A and 4B are a set of two perspective views illustrating the removal of the dust cup and filter assembly from the vacuum cleaner of FIG. 1 and the emptying of same.
Figure 10:
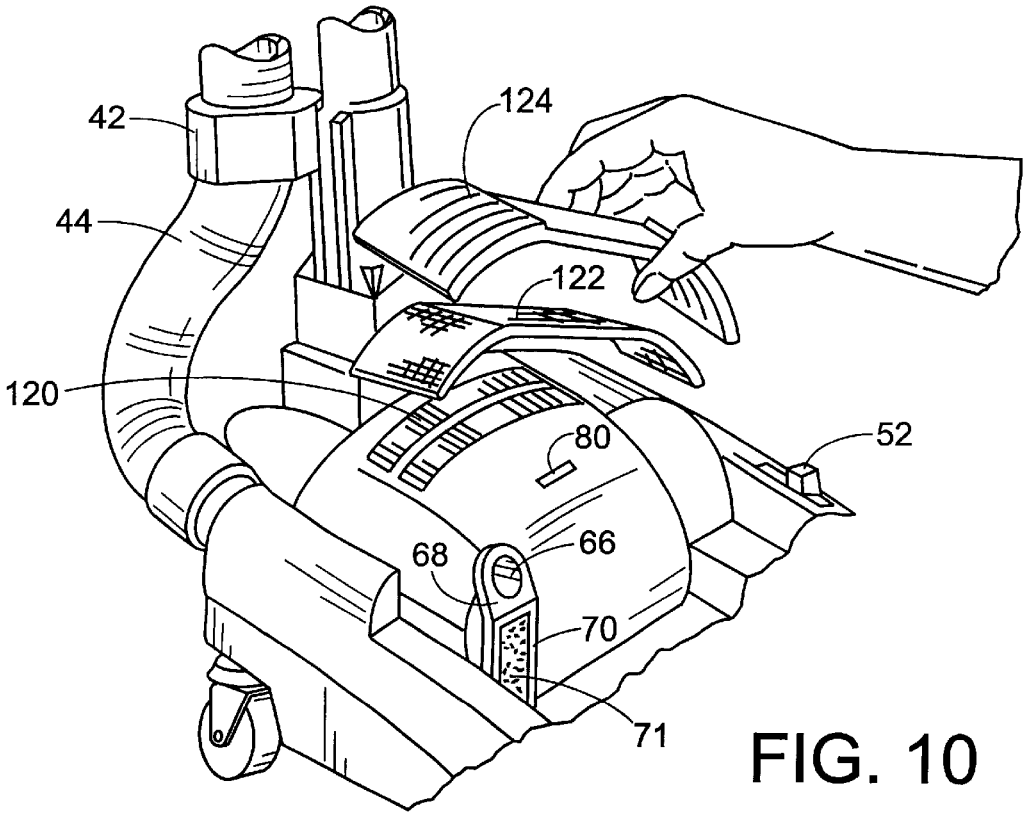
FIG. 10 is a perspective view illustrating removal of the exhaust filter and filter cover of the vacuum cleaner of FIG. 1.

The conduit 72 engages an auxiliary inlet opening 66 in the nozzle base (shown in FIG. 4A). As shown in FIG. 10, positioned on the end of the opening 66 is a sealing gasket 68. The sealing gasket 68 is used to prevent inlet air entering through inlet opening 66 from traveling directly into outlet opening 71 without first passing through a secondary filter 70. The auxiliary, secondary filter 70 is positioned within an outlet opening 71 in the nozzle base. The filter 70 is preferably made from a plastic mesh or foam and is relatively thick to substantially match the thickness of gasket 68.

Exhaust from the dust cup takes place through an outlet opening 94 shown on FIGS. 6 and 7. The outlet opening 94 communicates with outlet opening 71 and outlet opening 110 (shown in FIGS. 8A and 8B) located in a plastic housing 111 which connects the outlet opening 71 to the suction motor. The dust cup outlet opening 94 also has reinforcement ribs 88, 90. Outlet opening 94 and second inlet opening 96 are positioned on a raised portion 106 of the cover 64 as shown in FIG. 6. The filter 60 is positioned in front of the inlet opening 96 and outlet opening 94 as shown in FIG. 7. The cover 64 also includes a grip handle 92 which is used to pull the cover 64, along with the filter frame 62, off of the dust cup 12.

Referring to FIG. 2, for above-floor cleaning, a door 27 on the tool caddy 24 is opened to allow access to and removal and use of the attachment tools. The selector 52 is moved to the forward position to close the nozzle for above-floor cleaning. One of the tools is retrieved. The hose clips 42 are unclipped from a hose anchor on the elongated connecting portion 22 as shown in FIG. 11A. The handle 14 is removed from the elongated connecting portion 22 by pressing a tab (not shown) on the back side of the elongated connecting portion 22 to unlatch the handle, as shown in FIG. 11E. The handle 14 is hollow and has two open ends 40, 41 shown in FIG. 11E. End 40 connects the handle 14 with the elongated connecting portion 22. End 40 can also be used to connect one of the tools to the handle 14. The other end 41 connects the handle to the hose 44. One of the tools is then attached to the opening 40 of the handle 14 or to the elongated connecting portion 22. The elongated connecting portion 22 can serve as an extension wand for an above-floor tool assembly because it is hollow and has open ends 57, 58 (FIG. 11D). End 57 connects the elongated connecting portion 22 to the handle 14 and end 58 connects the elongated connecting portion to one of the tools.

To use the elongated connecting portion 22 as an extension wand tool, the hose clips 42 are unclipped from the hose anchor on the elongated connecting portion. As shown in FIG. 11B and 11C, the connecting portion 22 includes two sections secured end-to-end. Thus, the length of the connecting portion which is removed from the handle assembly 13 can be adjusted. The connecting portion 22 is removed at the desired length by pressing the tab to unlatch the connecting portion either at the nozzle base (with both sections being removed) or in the middle of the handle assembly (with only one section being removed). One of the tools is then secured to the end 58 of the elongated connecting portion 22 as shown in FIG. 11D.

For hands-free edge cleaning, the top of the hose 44 is removed from the handle element 14, as shown in FIG. 11E. The POWER EDGER™ tool 32 is inserted into the desired slot 50 at the front of the floor-traveling head 10, as shown in FIG. 11F. Then the vacuum cleaner can be moved along walls and baseboards for edge cleaning. The POWER EDGER™ tool has a triangular shape so that when it is installed in slot 50 it forms a corner on the vacuum cleaner and can be easily moved into a corner in a room and clean simultaneously both edges of the corner. The POWER EDGER™ tool can also be moved along a wall or baseboard for close contact with the adjacent wall or baseboard to provide effective cleaning of hard to reach areas.

FIG. 8A illustrates the air suction flow when an above-floor cleaning tool is used. The selector 52 is moved to the forward position to close the door 74 covering the first inlet opening 78 of the dust cup. The hose 44 is attached to the conduit 114 located at the rear of the nozzle base. The air flows from the above-floor cleaning tool to the hose 44 and through the conduits 112, 114 and through opening 66 into conduit 72 and second inlet opening 96 within the dust cup 12. The air then passes through the dust cup 12, reverses direction due to suction from the suction motor, and then passes through filter 60 into the outlet opening 94 and through filter 70 into opening 71. Dust and dirt and other particles are captured within the dust cup due to filter 60. Then the air passes into opening 110 to the suction motor. As shown in FIG. 10, an exhaust opening 120 with an exhaust filter 122 then discharges the air into the atmosphere. The exhaust filter 122 is preferably made from a thermoplastic material with a grid or mesh with openings large enough to allow air to pass through but small enough to prevent dust and debris from escaping to the atmosphere.

FIG. 8B illustrates the air suction flow for carpet or floor surface cleaning. The first inlet opening 78 of the dust cup 12 is opened by the door 74 which is held open by suction air flow and the air pressure differential between the air inside of the dust cup 12 and the ambient atmosphere outside of the vacuum cleaner. The air flows through the suction opening 79 of the nozzle base, through the inlet opening 78 of the dust cup 12, through filter 60, into the dust cup outlet opening 94 and through filter 70 into opening 71. Dust and dirt and other particles are captured within the dust cup 12 due to filter 60. Then the air passes into opening 110 to the suction motor. Exhaust opening 120 with an exhaust filter 122 then discharges the air into the atmosphere.

Figure 4B:
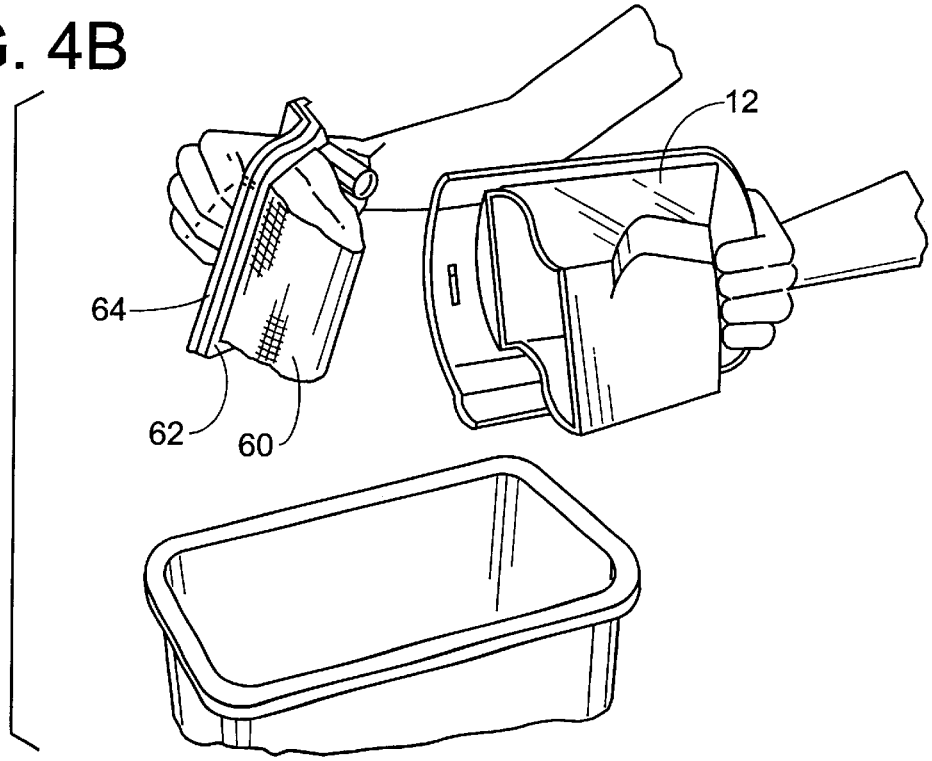

Referring to FIGS. 4A and 4B, to remove and empty the dust cup 12 and filter 60, the dust cup 12 is lifted from the back and pulled straight up and out of the nozzle. Then the filter 60, the filter frame 62 and the cover 64 are removed from the dust cup 12 by pulling on the cover handle 92. Then, the dirt or dust can be emptied from the dust cup 12 (see FIG. 4B). If desired, the filter 60 and filter frame 62 can be replaced with a new filter 60 and filter frame 62.

Figure 9:
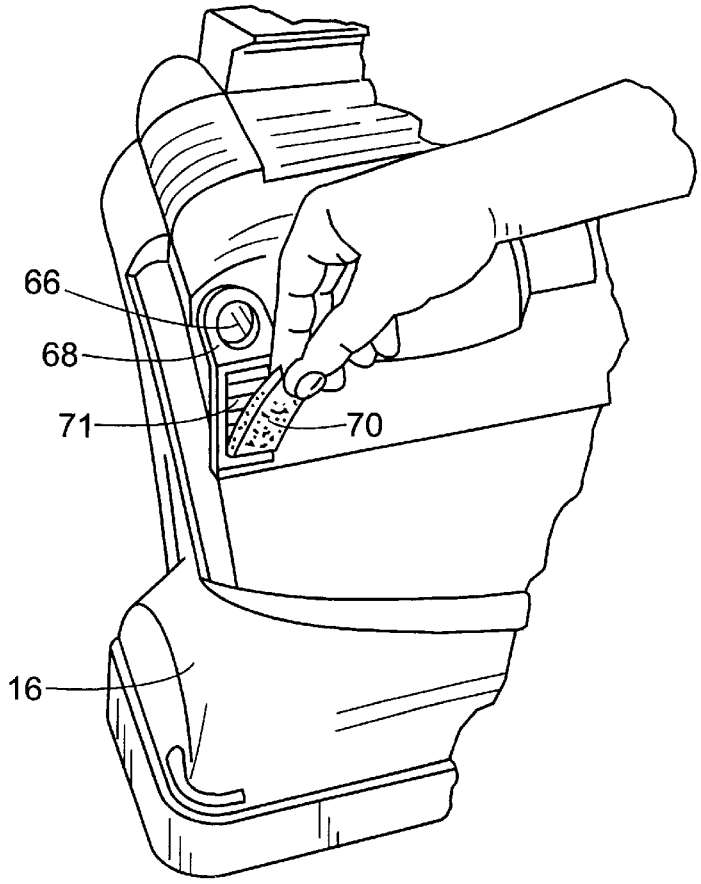
FIG. 9 is a perspective view of the vacuum cleaner of FIG. 1 illustrating removal of a second filter.

The second filter 70 can be removed and replaced from the opening 71 as shown in FIG. 9. The exhaust filter assembly can be removed and replaced by lifting off the exhaust cover 124 as shown in FIG. 10. Then the filter 122 is removed from the exhaust opening 120.

The invention has been described with reference to a preferred embodiment. Obviously, alterations and modifications will occur to others upon a reading and understanding of this specification. It is intended to include all such modifications and alternations insofar as they come within the scope of the appended claims or the equivalents thereof.

What is claimed is:

1. A vacuum cleaner comprising:

a nozzle base comprising a primary suction opening and a secondary suction opening formed therein, said secondary suction opening being spaced from said primary suction opening;

a suction source positioned within a first cavity defined in said nozzle base;

a dust cup assembly releasably positioned in a second cavity defined in said nozzle base, said dust cup assembly defining a dirt and dust collecting chamber, said dust cup assembly comprising:

a first inlet, said first inlet being in fluid communication with said primary suction opening, an outlet, said outlet being in fluid communication with said suction source, a filter assembly releasably positioned adjacent said outlet, said filter assembly comprising a first filter and a filter frame, a cover which is releasably attached to said filter frame, said cover forming a rear wall of said dust cup assembly, and a second inlet, said second inlet being in fluid communication with said secondary suction opening.

2. The vacuum cleaner of claim 1 wherein said second inlet is in fluid communication with an above-floor cleaning tool.

3. The vacuum cleaner of claim 1 wherein said cover comprises an inlet conduit and said outlet, wherein said inlet conduit is connected to said second inlet.

4. The vacuum cleaner of claim 3 wherein said cover further comprises a handle.

5. The vacuum cleaner of claim 1 further comprising a second filter positioned between said suction source and said first filter to prevent a flow of dirt and dust from said dirt and dust collecting chamber to said suction source.

6. The vacuum cleaner of claim 5 further comprising an exhaust opening positioned downstream said suction source and an exhaust filter located adjacent said exhaust opening to prevent particles that enter said suction source from venting to atmosphere.

7. A vacuum cleaner comprising:

a nozzle base comprising a primary suction opening and a secondary suction opening formed therein, said secondary suction opening being spaced from said primary suction opening;

a suction source positioned within a first cavity defined in said nozzle base;

a dust cup assembly releasably positioned in a second cavity defined in said nozzle base, said dust cup assembly defining a dirt and dust collecting chamber, said dust cup assembly comprising:

a first inlet, said first inlet being in fluid communication with said primary suction opening, an outlet, said outlet being in fluid communication with said suction source, and a second inlet, said second inlet being in fluid communication with said secondary suction opening, and a handle assembly, said handle assembly comprising:

an elongated connecting portion having a first end and a second end, wherein said elongated connecting portion is removably attached to said nozzle base at said first end, and a handle removably attached to said elongated connecting portion second end.

8. The vacuum cleaner of claim 7 wherein said handle is removed from said elongated connecting portion for use as an above-floor tool handle.

9. The vacuum cleaner of claim 8 wherein said elongated connecting portion is removed from said nozzle base for use as a wand for an above-floor cleaning tool.

10. The vacuum cleaner of claim 9 further comprising a hose which is removably attached to said handle at a hose first end and is removably attached to said nozzle base at a hose second end.

11. The vacuum cleaner of claim 10 further comprising at least one clip wherein said at least one clip secures said hose to said elongated connecting portion.

12. A vacuum cleaner comprising:

a nozzle base comprising a first end and a second end;

a first suction opening positioned adjacent said nozzle base first end;

a second suction opening positioned adjacent said nozzle base second end;

a suction source positioned within said nozzle base, said suction source being in fluid communication with said first and second suction openings;

a dust cup assembly releasably connected to said nozzle base, said dust cup assembly defining a dirt and dust collecting chamber, said dust cup assembly comprising a first inlet communicating with said first suction opening and a second inlet, spaced from said first inlet, communicating with said second suction opening; and a handle pivotally connected to said nozzle base.

13. The vacuum cleaner of claim 12 further comprising:

an elongated connecting portion removably attached to said nozzle base adjacent said second end thereof, wherein said handle is removably attached to said elongated connecting portion; and a hose having a first end and a second end, said hose being removably attached to said handle at said hose first end and being removably attached to said nozzle second suction opening at said hose second end.

14. The vacuum cleaner of claim 13 further comprising a tool caddy selectively mounted on said elongated connecting portion and at least one above-floor cleaning tool, wherein said tool caddy houses said at least one above-floor cleaning tool.

15. The vacuum cleaner of claim 14 wherein said at least one above-floor cleaning tool is removably attached to said hose first end.

16. The vacuum cleaner of claim 12 further comprising a sealing gasket positioned adjacent said second suction opening.

17. The vacuum cleaner of claim 12 wherein said dust cup assembly further comprises an outlet, said outlet being in fluid communication with said suction source.

18. The vacuum cleaner of claim 17 further comprising a filter assembly releasably positioned adjacent said outlet of said dust cup assembly, said filter assembly comprising a first filter and a filter frame.

19. The vacuum cleaner of claim 18 further comprising a cover which is releasably attached to said filter frame, said cover forming a rear wall of said dust cup assembly.

20. The vacuum cleaner of claim 18 further comprising a second filter positioned between said suction source and said first filter to prevent a flow of dirt and dust from said dirt and dust collection chamber to said suction source.

21. The vacuum cleaner of claim 20 further comprising an exhaust opening positioned adjacent said suction source and an exhaust filter located adjacent said exhaust opening to prevent particles that enter said suction source from venting to atmosphere.

22. A vacuum cleaner comprising:

a nozzle base including a first suction opening and a second suction opening spaced therefrom;

a suction source located within said nozzle base, said suction source being in fluid communication with said first and second suction openings;

an elongated connecting portion removably attached to said nozzle base;

a dirt and dust collecting chamber located on said nozzle base, said dirt and dust collecting chamber comprising a first inlet communicating with said first suction opening, an outlet communicating with said suction source, and a second inlet communicating with said second suction opening; and an above-floor cleaning assembly comprising:

a tool handle, said tool handle being removably attached to one end of said elongated connecting portion to also form a handle for the vacuum cleaner when so attached.

23. The vacuum cleaner of claim 22 further comprising a tool caddy mounted onto said elongated connecting portion and at least one above-floor cleaning tool, wherein said tool caddy houses said at least one above-floor cleaning tool.

24. The vacuum cleaner of claim 23 wherein said at least one above-floor cleaning tool is removably attached to said tool handle.

25. The vacuum cleaner of claim 22 further comprising a first filter releasably positioned adjacent said outlet of said dirt and dust collecting chamber.

26. The vacuum cleaner of claim 25 further comprising a second filter positioned between said suction source and said first filter to prevent a flow of dirt and dust from said dirt and dust collecting chamber to said suction source.

27. The vacuum cleaner of claim 26 further comprising an exhaust opening positioned adjacent said suction source and an exhaust filter located adjacent said exhaust opening to prevent particles that enter said suction source from venting to atmosphere.

28. The vacuum cleaner of claim 22, further comprising a hose having first and second ends, wherein said first end is removably attached to said tool handle and said second end is removably attached to said nozzle base second suction opening.

29. A vacuum cleaner comprising:

a nozzle base comprising a primary suction opening and a secondary suction opening formed therein, said secondary suction opening being spaced from said primary suction opening;

a suction source positioned in said nozzle base;

a pair of wheels rotatably mounted to said nozzle base for moving said nozzle during vacuuming;

a handle portion pivotably attached to said nozzle base; and a dust cup assembly releasably mounted to said nozzle base, said dust cup assembly defining a dirt and dust collecting chamber, said dust cup assembly comprising:

a first inlet, said first inlet being in fluid communication with said primary suction opening, an outlet, said outlet being in fluid communication with said suction source, and a second inlet spaced from said first inlet, said second inlet being in fluid communication with said secondary suction opening.

* * * * *